US007027361B2

(12) United States Patent
Burkhardt et al.

(10) Patent No.: US 7,027,361 B2
(45) Date of Patent: Apr. 11, 2006

(54) PERPETUAL CALENDAR FOR A TIMEPIECE

(75) Inventors: Wolfgang Burkhardt, Ispringen (DE); Louis M. Galie, Newtown, CT (US); Michel G. Plancon, Besancon (FR); Helmut Zachmann, Remchingen (DE); Gerhard Stotz, Eisingen (DE); Siegfried Grau, Pforzheim (DE)

(73) Assignee: Timex Group B.V., (NL)

( * ) Notice: Subject to any disclaimer, the term of this patent is extended or adjusted under 35 U.S.C. 154(b) by 98 days.

(21) Appl. No.: 10/716,011

(22) Filed: Nov. 18, 2003

(65) Prior Publication Data

US 2005/0105398 A1 May 19, 2005

(51) Int. Cl.
*G04B 19/20* (2006.01)
*G04B 19/24* (2006.01)

(52) U.S. Cl. ..... 368/37; 368/38

(58) Field of Classification Search ..... 368/35, 368/37, 38, 34

See application file for complete search history.

(56) References Cited

U.S. PATENT DOCUMENTS 3,815,351 A * 6/1974 Vovelle ..... 368/28
4,254,490 A * 3/1981 Ganter ..... 368/29
4,427,300 A * 1/1984 Groothuis ..... 368/37
4,540,291 A * 9/1985 Dubois ..... 368/28
5,384,754 A * 1/1995 Besson ..... 368/28
6,088,302 A 7/2000 Nakajima et al.
6,240,052 B1 * 5/2001 Kitajima et al. ..... 368/28
6,385,136 B1 * 5/2002 Higuchi et al. ..... 368/28
6,477,114 B1 * 11/2002 Mutoh et al. ..... 368/28
6,582,118 B1 6/2003 Nakajima et al.
6,584,040 B1 6/2003 Nakajima et al.
6,766,459 B1 * 7/2004 Shimura et al. ..... 713/320

* cited by examiner

*Primary Examiner*—Andrew H. Hirshfeld
*Assistant Examiner*—Leo T. Hinze
(74) *Attorney, Agent, or Firm*—Carmody & Torrance LLP

(57) ABSTRACT

A timepiece comprising a date display, comprising a date display assembly comprising a date ring, a first gearing assembly being meshingly coupled to the date ring for causing the rotation of the date ring; and a stepping motor comprising a rotor, wherein the rotor of the stepping motor is rotateably coupled to the at least one or more wheels of the first gearing assembly, wherein the rotation of the rotor causes the date ring to rotate; a date-keeping assembly operatively coupled to the date display assembly, comprising: at least a second gearing assembly comprising at least an hour wheel and a detection wheel assembly, wherein at least certain rotational increments of the detection wheel, and the clockwise or counterclockwise direction thereof, causes the rotor of the stepping motor to rotate so that the date ring can be rotated in one of a clockwise or counterclockwise direction; whereby the rotation of the hour wheel through a predetermined midnight position results in that the stepping motor causes the date ring to rotate a predetermined number of degrees, thereby advancing either in the forward or backward direction a displayed digit on the date ring representing a valid date. Methodologies for setting and adjustment are also provided.

13 Claims, 8 Drawing Sheets

PERPETUAL CALENDAR FOR A TIMEPIECE

BACKGROUND OF THE INVENTION

The present invention relates generally to timepieces, such as wristwatches, and in particular, to improved constructions and methodologies for maintaining accurate date and/or day information, in such timepieces that comprise a date and/or day ring, such as those timepieces typically referred to as "analog" or "quartz-analog" watches having hands for displaying time, and which drive the date ring as a function of the rotation of one or more gears (or "wheels"), such as (by way of example) the wheel that is coupled to the hour hand. In particular, the present invention provides an improved construction and methodology for maintaining an accurate date and/or day display even if the hour/minute hands are mechanically and/or electrically decoupled from the date display assembly.

That is, in a conventional quartz analog timepiece, the stopping of the hour/minute hands typically results in an inability of the date ring from rotating, thus leading to a loss of accurately displayed date and (possibly) day information. Moreover, if the hands are disengaged or otherwise stopped for a significant amount of time (e.g. days or weeks), any calendar date ring would have to be significantly readjusted (e.g. manually), a problem that becomes even more significant if the timepiece includes a month or day display or other perpetual calendar features. Although such disengagement of the hands may occur only momentarily or for short durations due to inadvertence or time setting, users may also intentionally disengage or otherwise stop the hands on the assumption that energy is being conserved.

Attempts have been made to overcome the foregoing perceived deficiencies. For example, in at least one known "perpetual calendar" watch design, the hands and the calendar ring are driven directly by motors that are controlled by a microprocessor. In such a construction, every step of every motor is processed and maintained by the microprocessor, such that every position of every hand, as well as the positioning of the day/date ring, is maintained by the microprocessor. Such a construction does not require any "midnight" detector even if the hands are stopped, since the microcontroller always knows and controls the position of the hands and day/date ring when running and/or how long they have been disengaged or otherwise stopped. However, all hand-setting functionality must therefore also be controlled by the microprocessor. And, for a three-hand (e.g. hour, minute, second) display, at least two (2) motors would be required, thus complicating the time setting and/or date readjusting operations, as would be understood and appreciated by one skilled in the art.

At least one other approach to the concept of a "perpetual calendar" watch has been put forth, whereby the hands are driven by only one motor, as in a "standard" quartz analog movement, thus allowing for mechanical and manual hand setting. In this implementation however, a 24-hour or "midnight" detector is needed to control the rotational advancement of the date ring. Disadvantageously, while the hands are stopped, there is no continuing signal to tell the microcontroller to rotate the date ring, thus maintaining the perceived deficiencies stated above. Moreover, the perceived deficiencies with this construction are increased when one extends the functionality to the incorporation of a day disc, which during normal operation, rotates in synchronization with the hour hand. Upon the stoppage of the hands for a long period of time, the discrepancies between the accuracies of these two rings (day and date) become even further pronounced. Complicated constructions have been used to attempt to deal with these and other problems, and the reader may wish to review U.S. Pat. Nos. 6,088,302; 6,582,118; and 6,584,040 (collectively the "Seiko patents") in this regard. To the extent that such subject matter does not conflict with the invention disclosed herein, the disclosure of the Seiko patents is incorporated by reference as if fully set forth herein.

Another deficiency in the prior art is the inability to adequately and accurately maintain (or update) the display of the proper day on a day ring, in the event that the hands of the timepiece are stopped. Moreover, adjusting the day by a typical hand-setting operation thereafter will tend to further misadjust the date being displayed on the date ring since the typical synchronization between the hands and the date and day rings does not typically allow for independent calibration. This is a problem that is also overcome by the present invention.

Accordingly, it is desirable to provide a timepiece with an improved calendar function that overcomes the perceived deficiencies in the prior art noted above and further achieves the aforementioned and below mentioned objectives.

SUMMARY AND OBJECTIVES OF THE INVENTION

Accordingly, it is an objective of the present invention to provide a timepiece with an improved calendar function.

Specifically, it is an object of the present invention to provide an improved timepiece comprising a date and/or day display.

Another object of the present invention to provide an improved timepiece comprising a date and/or day display that utilizes stepping motors, such as bi-directional stepping motors, since by way of but one advantage, the use of stepping motors ensures correct driving angles from one date to the other without any additional required contact to stop the motor when rotation has to be terminated.

Another object of the present invention to provide an improved timepiece comprising a date and/or day display that is easy to adjust and furthermore, whereby the accuracy of the calendar date and/or day can be continuously and accurately maintained.

Yet another object of the present invention to provide an improved timepiece comprising a date and/or day display that does not require any particular time reference to compute the elapsed 24-hour periods of time. For example, it is an object of the present invention to merely maintain elapsed periods of time from when the hands are first disengaged, such that reaching each 24 hours of elapsed time causes the date ring to advance to the next date.

Still another object of the present invention is to provide an easier and faster way to set date and/or day displays in a timepiece that displays such information, especially in an analog timepiece.

Still another specific object of the present invention is to provide an improved timepiece comprising a day display which incorporates the use of a counter that allows for the maintaining of accurate relative day information.

Yet another object of the present invention to provide an improved timepiece comprising a date and/or day display that optimizes space constraints.

And yet another object of the present invention to provide an improved timepiece comprising a date and/or day display that does not require the precision electrical contact reliability which is otherwise needed in prior art embodiments to even begin to achieve the advantages set forth herein.

Still other objects and advantages of the invention will in part be obvious and will in part be apparent from the specification.

The invention accordingly comprises the features of construction, combination of elements, arrangement of parts and sequence of steps which will be exemplified in the construction, illustration and description hereinafter set forth, and the scope of the invention will be indicated in the claims.

Generally speaking, in accordance with the present invention, an improved timepiece comprising a date display is provided. In the preferred embodiment, the timepiece comprises: a date display assembly comprising: a date ring having a plurality of digits thereon; a first gearing assembly comprising one or more wheels, being meshingly coupled to the date ring so that the rotation of the one or more wheels causes the rotation of the date ring; and a stepping motor comprising a rotor, wherein the rotor of the stepping motor is rotateably coupled to the at least one or more wheels of the first gearing assembly, wherein the rotation of the rotor causes the date ring to rotate; a date-keeping assembly operatively coupled to the date display assembly, comprising: at least a second gearing assembly comprising at least an hour wheel and a detection wheel assembly operatively coupled by rotation to the hour wheel, wherein at least certain rotational increments of the detection wheel, and the clockwise or counterclockwise direction thereof, causes the rotor of the stepping motor to rotate so that the date ring can be rotated in one of a clockwise or counterclockwise direction; whereby the rotation of the hour wheel through a predetermined midnight position results in that the stepping motor causes the date ring to rotate a predetermined number of degrees, thereby advancing either in the forward or backward direction a displayed digit on the date ring.

In accordance with another embodiment of the present invention, the timepiece preferably comprises: a date display assembly comprising: a date ring having a plurality of digits thereon; a first gearing assembly comprising one or more wheels, being meshingly coupled to the date ring so that the rotation of the one or more wheels causes the rotation of the date ring; and a stepping motor comprising a rotor, wherein the rotor of the stepping motor is rotateably coupled to the at least one or more wheels of the first gearing assembly, wherein the rotation of the rotor causes the date ring to rotate; a date-keeping assembly operatively coupled to the date display assembly, comprising: at least a second gearing assembly comprising at least an hour wheel and a detection wheel operatively coupled by rotation to the hour wheel, and a microcontroller, wherein the microcontroller receives signals based on at least certain rotational increments of the detection wheel, and wherein the microcontroller can maintain information regarding the clockwise or counterclockwise direction of the detection wheel, and further wherein the microcontroller processes such signals and based thereon, causes the rotor of the stepping motor to rotate in one of a clockwise or counterclockwise direction so that the date ring can be rotated in one of a clockwise or counterclockwise direction; whereby the rotation of the hour wheel through a predetermined midnight position results in the date ring rotating a predetermined number of degrees, thereby advancing either in the forward or backward direction a displayed digit on the date ring.

Lastly, in accordance with a preferred embodiment of maintaining and displaying at least one of date and day information in a timepiece, a method is provided comprising the steps of determining when the microcontroller has stopped the rotation of the rotor of the second stepping motor, and commencing a measuring of an elapsed period of time; wherein the commencement of the measurement step is independent of the time of day; determining when the elapsed period of time is at least essentially equal to 24 hours; and stepping the rotor of the first stepping motor in a direction so that the date ring rotates and the digit on the date ring showing the valid date is displayed.

In yet another feature of the present invention, the method comprises the steps of: measuring the number of elapsed 24 hour periods of time; and, while the microcontroller is not providing signaling to rotate the second stepping motor and the setting stem is engaged with the gearing arrangement: adjusting the day disc by rotating the setting stem, wherein the day disc is adjustably rotated a calculated number of days depending on the number of measured elapsed 24 hour period of times; and blocking further rotation of the date ring by preventing the rotation of the rotor of the first stepping motor until the day disc has been rotated the calculated number of days.

In still another embodiment of the present invention, the method comprises the steps of determining that the detection wheel assembly has been rotated a certain number of rotational increments in the clockwise or counterclockwise direction; and causing the rotor of the stepping motor to rotate so that the date ring can be rotated in one of a clockwise or counterclockwise direction.

BRIEF DESCRIPTION OF THE DRAWINGS

For a fuller understanding of the invention, reference is had to the following description taken in connection with the accompanying figures, in which.

Also, while not all elements are labeled in each figure, all elements with the same reference number indicated similar or identical parts.

DETAILED DESCRIPTION OF THE PREFERRED EMBODIMENTS

Figure 8:
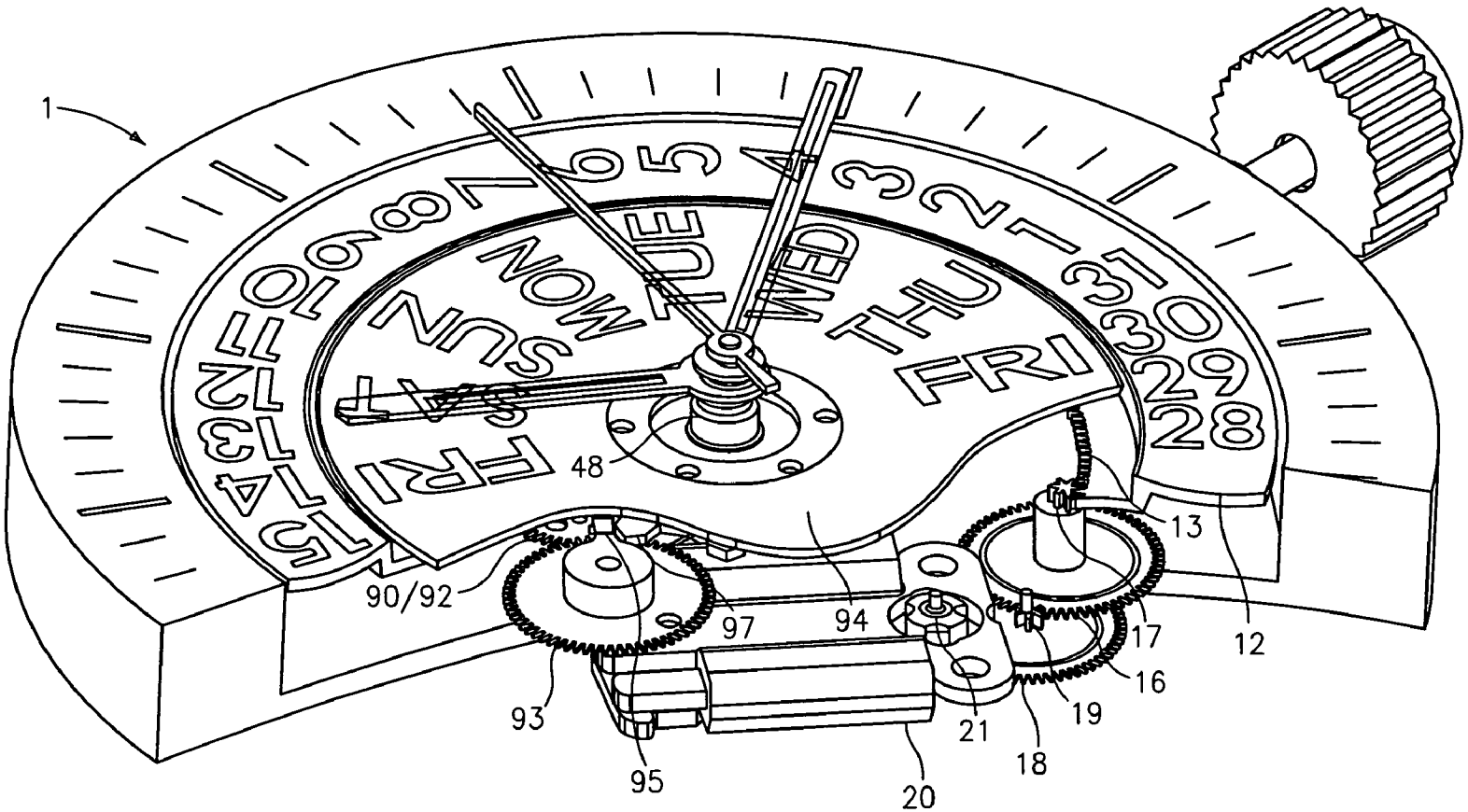
FIG. 8 is a perspective view (in partial cutaway) of a timepiece incorporating the date and/or day display of the present invention.

Reference shall first be made to FIGS. 1–6, wherein the relevant portions of a timepiece, generally indicated at 1 (and shown generally in FIG. 8) and including features of the present invention, is disclosed.

Figure 1:
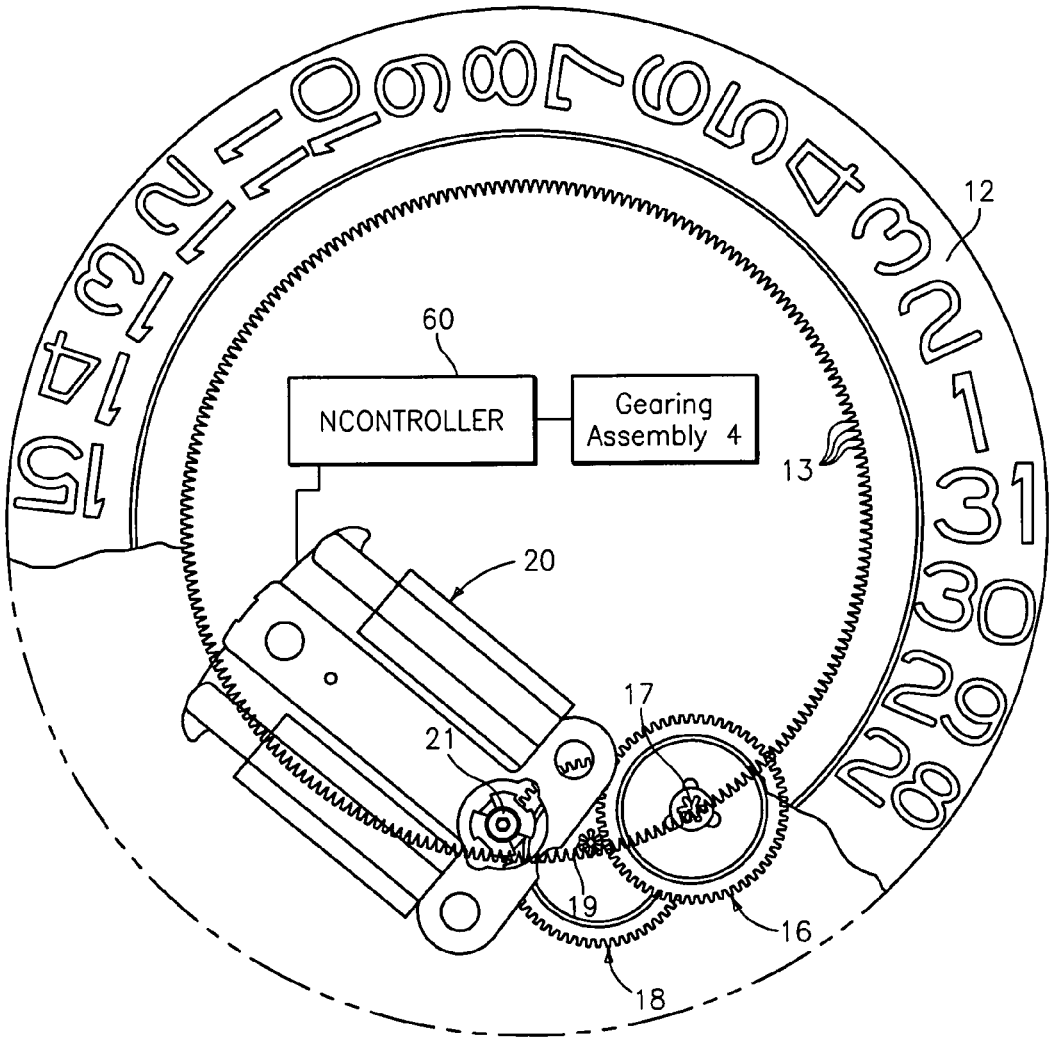
FIG. 1 is a top plan view of a date display assembly constructed in accordance with the present invention.

FIG. 1 most clearly illustrates a preferred construction of a date display assembly constructed in accordance with the present invention. Specifically, the date display assembly comprises a date ring 12, on which a plurality of digits (e.g. "1", "2", "3," . . . "31") may be printed, silkscreen, painted, or otherwise provided. Date ring 12 preferably has a plurality of teeth 13 on the inner circumference thereof for meshing with a gearing assembly which will now be disclosed.

Specifically, in the preferred embodiment, the gearing assembly for the date display assembly comprises one or more wheels. Illustrated in FIG. 1 is a date wheel 16 on which is a pinion 17, which is coupled to date ring 12 via teeth on pinion 17 being in meshing alignment with teeth 13 of date ring 12. The gearing assembly also includes an intermediate date wheel 18, which itself also includes a pinion 19 that is in meshing alignment with the outer teeth of date wheel 16. In this way, the rotation of the one or more wheels (e.g. date wheel 16 and intermediate date wheel 18) causes the rotation of date ring 12, as will be further explained below. Of course, it should be understood that the number of wheels included in the gearing assembly may be more or less than that disclosed herein, and are really one of design choice for the intended function and based upon a number of known criterions, such as power and torque constraints.

Lastly, the date display assembly of the preferred embodiment preferably also comprises a stepping motor, generally indicated at 20. Stepping motor 20 will comprise a rotor 21, which in the preferred embodiment, is rotatably coupled to the at least one or more wheels of the first gearing assembly (e.g. intermediate date wheel 18). That is, rotor 21 will preferably comprise teeth that meshingly aligns with the outer teeth on intermediate date wheel 18.

The selection of a suitable stepping motor and the arrangement and/or positioning of the components are all within the purview of one skilled in the art.

In continuing to disclose the particulars of timepiece 1 that make-up the present invention, reference is now made to FIGS. 2–5, wherein the specifics of a date-keeping assembly (generally indicated by reference numeral 4 in FIG. 2), constructed in accordance with the present invention, is disclosed. Specifically, the date-keeping assembly of the present invention comprises at least a second gearing assembly comprising in particular, at least an hour wheel 48 and a detection wheel assembly, generally indicated at 53, which is operatively coupled by rotation to hour wheel 48. Although one skilled in the art would readily understand the relationships and intercouplings of the wheels illustrated in FIGS. 2–5, the following is set forth for completeness.

Specifically, the date-keeping assembly of the present invention comprises yet at least a second stepping motor 30, which for obvious reasons, need not be a bi-directional stepping motor. As most clearly illustrated in FIGS. 2–3, stepping motor 30 includes a rotor 32 that is meshingly engaged with intermediate wheel 34. Intermediate wheel 34 includes a pinion 35 that is meshingly engaged with a second wheel 36. Second wheel 36 includes a pinion 38 that is meshingly engaged with a third wheel 40. A pinion 42 of third wheel 40 is meshingly engaged with a center wheel 44. The outer circumference of center wheel 44 is in meshing alignment with minute wheel 46. A pinion 47 of minute wheel 46 is meshingly aligned and engaged with hour wheel 48. Completing the date keeping assembly, hour wheel 48 in turn is in meshing alignment with an intermediate wheel 50. Intermediate wheel 50 has a pinion 52 which is in meshing alignment with the outer circumference of the toothed wheel portion which makes up a part of detection wheel assembly 53.

As also would be clearly understood by one skilled in the art, coupled to second wheel 36 is the second hand (not shown), coupled to center wheel 44 is the minute hand (not shown) and coupled to hour wheel 48 is the hour hand (not shown).

In this way, it can be seen that the rotation of hour wheel 48 will cause, via intermediate wheel 50, the rotation of detection wheel assembly 53. It can also be seen that the direction of rotation of detection wheel assembly 53 (i.e. clockwise or counterclockwise) can also be controlled by the direction of rotation (i.e. clockwise or counterclockwise) of hour wheel 48.

Thus, it can now be seen that if timepiece 1 can maintain information regarding the clockwise or counterclockwise direction (and amount of rotation) of detection wheel assembly 53, timepiece 1 can accurately cause the rotor of stepping motor 20 to rotate in one of a forward or reverse direction (as the case may be) so that date ring 12 can be rotated in the proper clockwise or counterclockwise direction. To assist in providing this functionality, a microcontroller 60 is provided. Likewise, in place of a microprocessor, a quartz analog circuit can be utilized. Specifically, microcontroller 60 will receive signals upon at least certain rotational increments of detection wheel assembly 53, process such signals and based thereon, cause the rotor of stepping motor 20 to rotate in the proper clockwise or counterclockwise direction so that date ring 12 can, as the case may be, rotate clockwise or counterclockwise. In this way, the rotation of hour wheel 48 through a predetermined "midnight" position results in date ring 12 rotating a predetermined number of degrees, thereby advancing either in the forward or backward direction a displayed digit on date ring 12.

How microcontroller "knows" and maintains information regarding the direction of rotation of detection wheel assembly 53 is the subject matter of the next segment of the disclosure.

Figure 2:
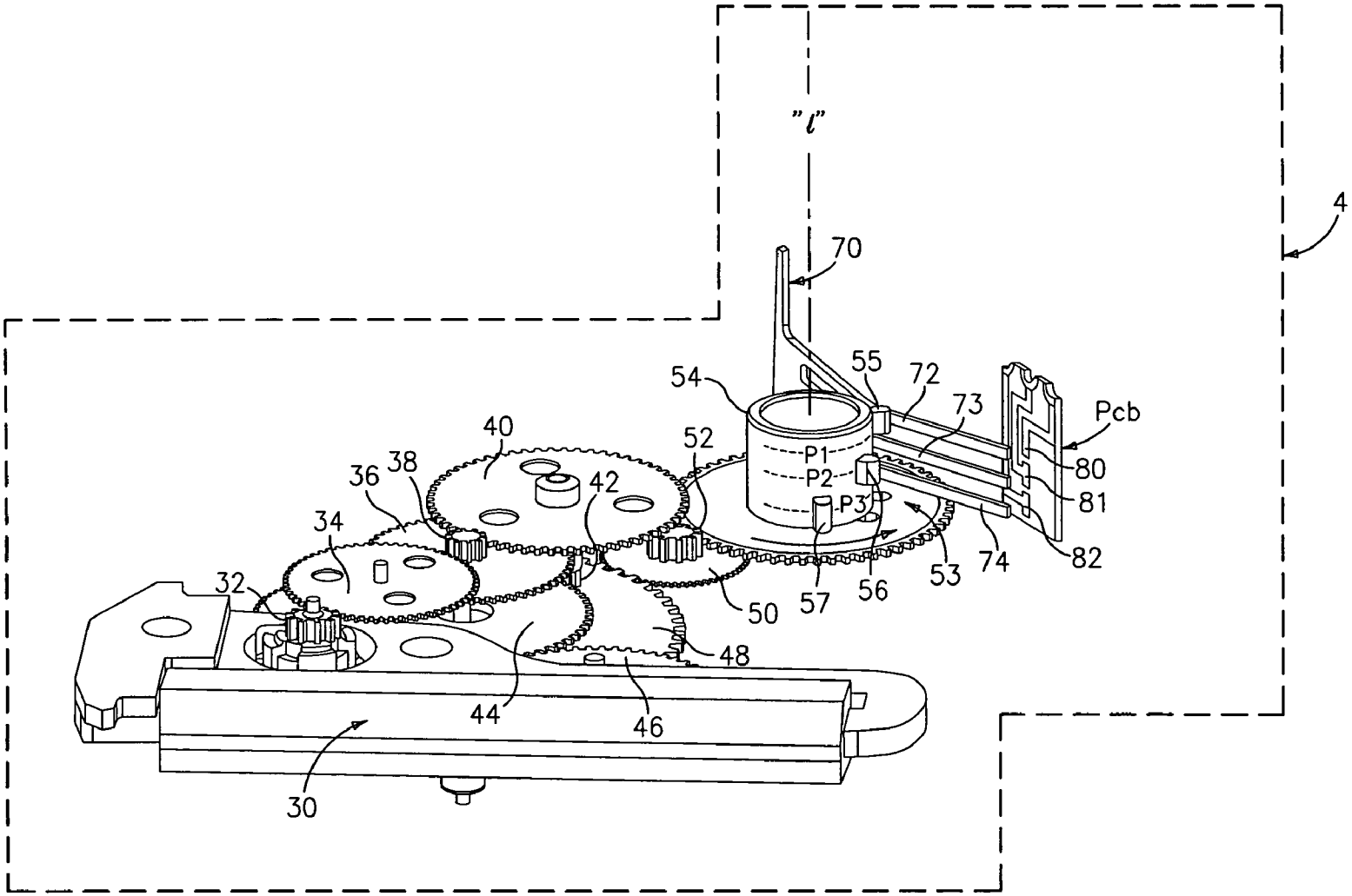
FIG. 2 is a perspective view of a date-keeping assembly in accordance with the present invention showing in particular a detection wheel and a spring assembly, which will be further disclosed below.
Figure 3:
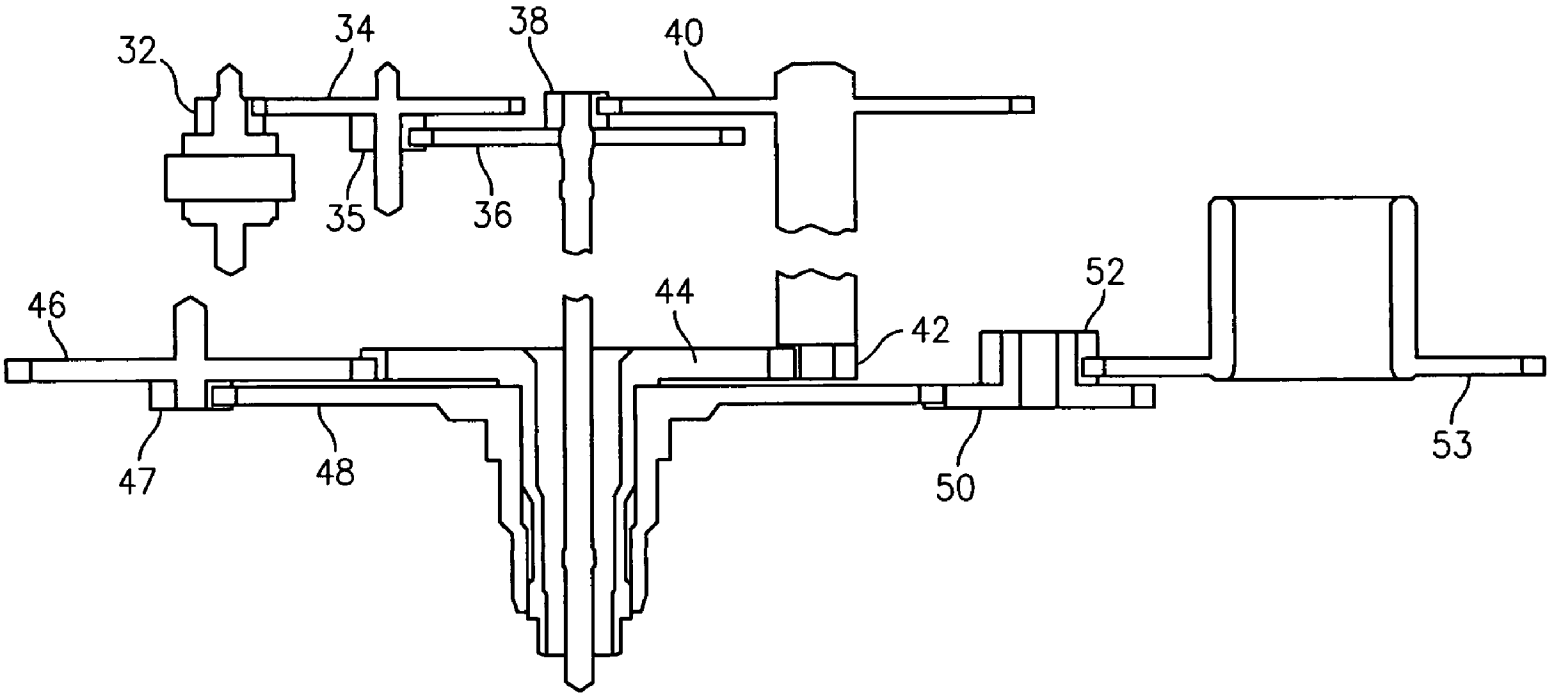
FIG. 3 is a cross-sectional view of the date-keeping assembly illustrated in FIG. 2.
Figure 4:
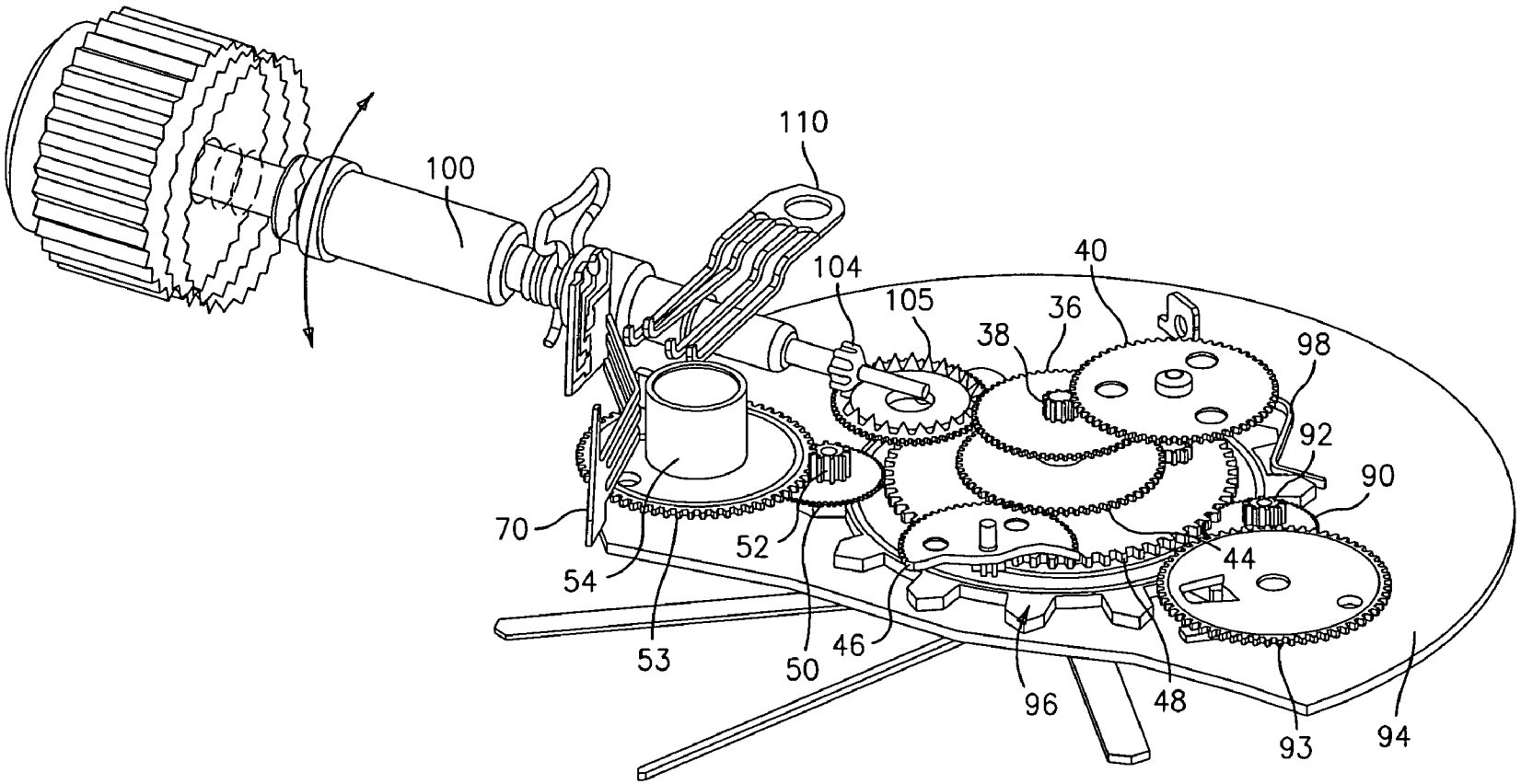
FIG. 4 is a perspective view illustrating the date-keeping assembly of the present invention showing in particular a day-keeping assembly constructed in accordance with the present invention.

As illustrated in FIGS. 2 and 4, the date-keeping assembly also comprises a spring assembly, generally indicated at 70, which comprises at least three deflectable fingers, namely fingers 72, 73 and 74, while detection wheel assembly 53 preferably comprises a cylinder element 54 including a first tab 55, a second tab 56 and a third tab 57. Each tab is positioned such that only first tab 55 is contactable with first finger 72; only second tab 56 is contactable with second finger 73; only third tab 57 is contactable with third finger 74. That is, as most clearly illustrated in FIG. 2, each tab is positioned in a different horizontal plane (see P1, P2 and P3 markings on cylinder element 54) and offset from each other when viewed along a longitudinal axis "1" thereof. That is, no two tabs 55, 56 and 57 are vertically or horizontally aligned with each other.

In conjunction therewith, the date-keeping assembly comprises first, second and third electrically conductive pads (80, 81, 82) which are operatively (e.g. electrically) coupled to microprocessor 60. Each of the respective fingers is aligned with a respective pad such that: when first tab 55 contacts first finger 72, first finger 72 makes electrical contact with first conductive pad 80; when second tab 56 contacts second finger 73, second finger 73 makes electrical contact with second conductive pad 81; and when third tab 57 contacts third finger 74, third finger 74 makes electrical contact with third conductive pads 82. Tabs 55, 56 and 57 are offset from each other such that no two electrical conductive pad 80, 81 or 82 can simultaneously be contacted. As should now be understood, microcontroller 60 can receive and maintain information about the rotation of detection wheel assembly 53, and in particular whether detection wheel assembly 53 is rotating in the clockwise or counterclockwise direction based on the respective sequence of contacts between the deflectable fingers and their respective conductive pads.

Clearly, the three conductive pads 80, 81 and 82 may be electrically coupled to Vdd or Vss, as one skilled in the art would readily appreciate. Thus, in an exemplary embodiment, stepping motor 20 may cause the rotation, in the manner set forth above, of date ring 12 such that a subsequent digit is displayed (e.g. "2" to "3"; "15" to "16"; or "31" to "1"; in the cases the actual month having 30 days only, the microcontroller lets the date disc turning directly from "30" to "1"; likewise the microcontroller can maintain accurate date information so that the date disc turns directly from "28" to "1" at the end of February and from "29" to "1" in leap years) if microcontroller 60 detects an electrical connection between second finger 73 and second conductive pad 81 and the previously detected electrical connection was between first finger 72 and first conductive pad 80. It should be obvious that such respective contacts are caused by the respective deflection of fingers 73, 72 by respective tabs 56, 55. On the other hand, date ring 12 can be rotated in a counterclockwise direction by the appropriate rotation of the rotor of stepping motor 20 such that a previous digit is displayed (e.g. "3" to "2"; "16" to "15"; or "1" to "31", and similarly, in the cases where the prior month has 30 days only, the microcontroller lets the date disc turning directly from "1" to "30"; from "1" to "28" when the prior month is February and not a leap year, and from "1" to "29" in leap years when the prior month is February). The counterclockwise rotation of date ring 12 will occur if microcontroller 60 detects an electrical connection between first finger 72 and first conductive pad 80 and the previously detected electrical connection was between second finger 73 and second conductive pad 81. As one skilled in the art would readily appreciate, the incorporation of a third finger assists in detecting the direction of rotation of detection wheel assembly 53. In this way, the microcontroller can "know" that hour wheel 48 is turning in the direction such that the hour hand is moving back through the midnight position (e.g. 1:00 a.m.→12:00 midnight→11:00 p.m.).

Figure 5A:
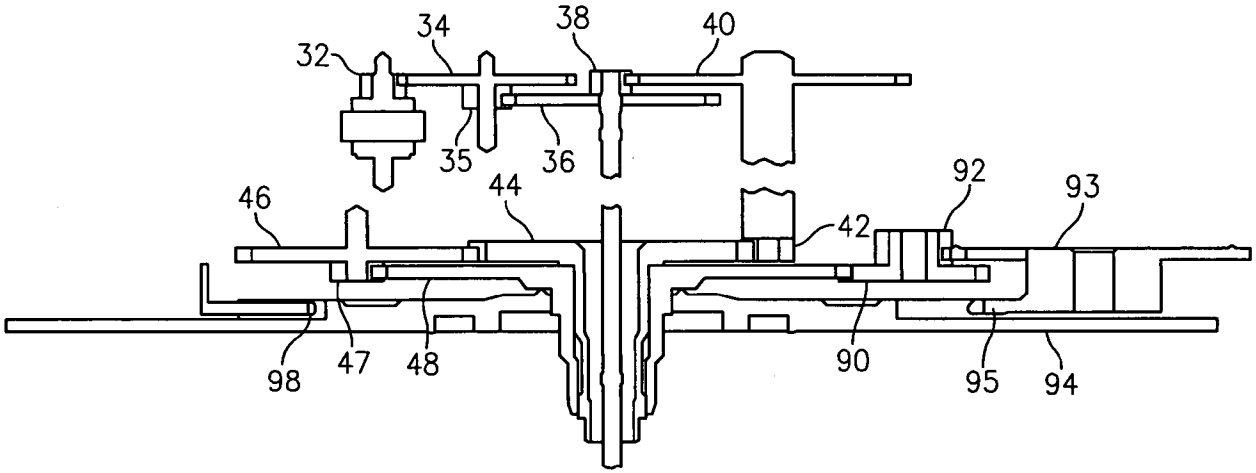
FIGS. 5A and 5B are cross-sectional views illustrating, among other things, the day-keeping, the date display, and the date-keeping assemblies of the present invention.
Figure 5B:
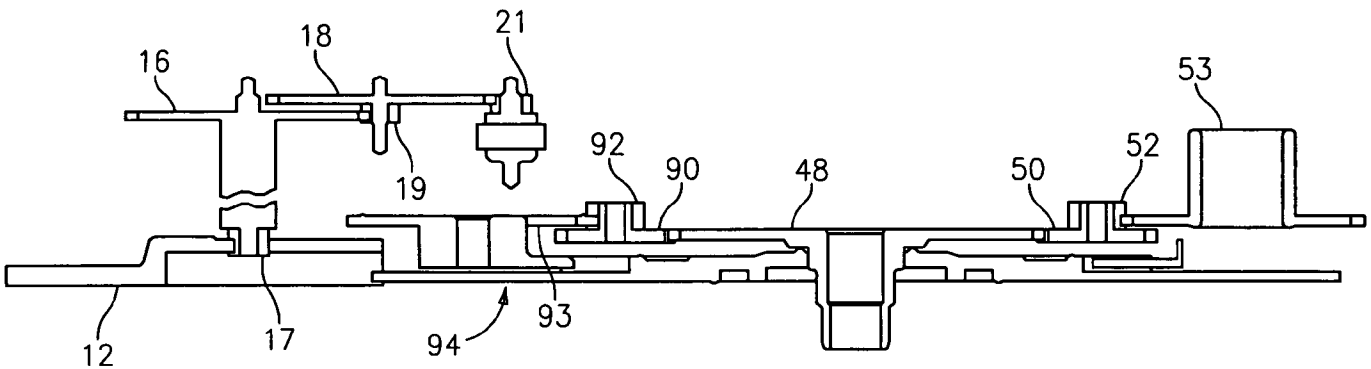
Figure 6:
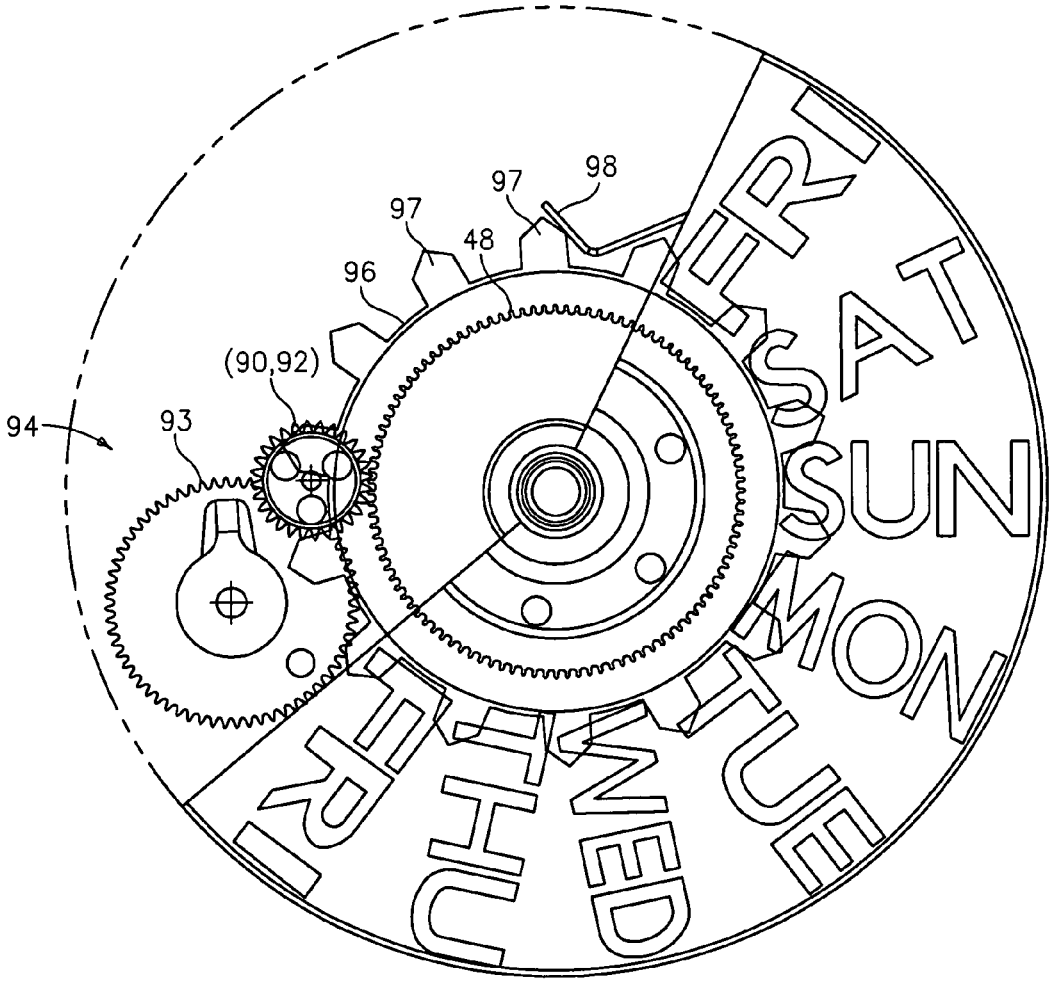
FIG. 6 is a top plan view of the day-keeping assembly of the present invention.

Reference is now specifically made to FIGS. 4–6 for a discussion of another feature of the present invention, namely, the construction of a day-keeping assembly in accordance with the present invention.

Here, day-keeping assembly preferably comprises an intermediate wheel 90, which itself includes a pinion 92 that is meshingly engaged with a day wheel 93. A purpose of day wheel 93 is to rotate a day disc 94, which itself has the days of the week printed, silkscreen, painted, or otherwise provided thereon. A sprocket, generally indicated at 96, with a plurality of extending posts 97, is directly coupled to day disc 94, such that rotating sprocket 96 causes the rotation of day disc 94.

To rotate sprocket 96, a leg 95 is provided on the dial side of day wheel 93. In this way, with each full rotation of day wheel 93, leg 95 will engage the "next" post 97, thereby urging it in the direction such that the next subsequent day is displayed. To assist in this operation, a spring 98 is provided to assist in urging the rotation of day disc 94 to its next "day position." This spring is provided to avoid the need for leg 95 to move the post to its fully next position on its own. That is, all leg 95 has to do is urge the post sufficiently until the spring is biased such that it is able to "snap" sprocket 96 to its next "resting" (i.e. day) position and to detent it there until the next gearing. In this way, it can be seen that rotation of the hour wheel during normal "run" mode or a hand setting mode, will cause the day disc to rotate.

In accordance with another feature of the present invention, accurate date information can be maintained when the hands (e.g. hour wheel 48) have been stopped, whether intentionally or inadvertently. That is, it may be recalled from above that in a gearing arrangement wherein the date ring of such a "perpetual calendar" is controlled (or at least influenced) by the rotation of another wheel in the timekeeping gear train, there is typically no signal to drive the date ring (i.e. date ring 12) while the hands are stopped. In accordance with the present invention, all of the signaling for the rotation of the date ring may be initiated by microcontroller 60.

Such would be the case in the present invention if stem 100, illustrated in FIG. 4, was in the illustrated position such that a toothed wheel 104 of stem 100 was engaged with setting wheel 105. In such an example, the hands would not be free to turn by the rotation of stepping motor 30 (which would be now disabled), all as disclosed in copending application Ser. No. 10/349,339, the disclosure of which is incorporated by reference as if fully set forth herein. In such a hand setting position, there would be the appropriate spring deflection of spring contact 110 causing the stopping of the rotation of the rotor of stepping motor 30. The foregoing would be more fully appreciated from a reading of copending application Ser. No. 10/331,827, the disclosure of which is also incorporated by reference as if fully set forth herein. In this case, therefore, the turning of the date ring would have to be caused by signaling directly to motor 20 (or more accurately, to its motor driver (not shown)), as would be appreciated by one skilled in the art.

Generally speaking, the present invention achieves this objective by counting periods of 24 hours, beginning when the hands are stopped. With each passage of 24 hours while the hands are stopped, the date ring is advanced one position (i.e. "1"→"2"). The reference timing signals may be generated by a quartz oscillator (not shown). Here, a counter (by way of example) may maintain the 24-hour count. Reaching the 24 hours would result in date ring 12 turning to the next valid date and restarting the counter for the next 24-hour period. It should be appreciated, that in the worst-case scenario (i.e. manually stopping the hands at 11:59 p.m.), the maximum number of days that the timepiece would be "off" would be one (1). Such an error is clearly tolerable since it is such an improvement over the state of the art constructions. When the hands are reengaged (i.e. in a normal "run" mode), the user would then merely have to determine whether the next 12:00 o'clock reading was noon or midnight (by viewing whether the date ring advanced), and adjust the hands accordingly.

Figure 7:
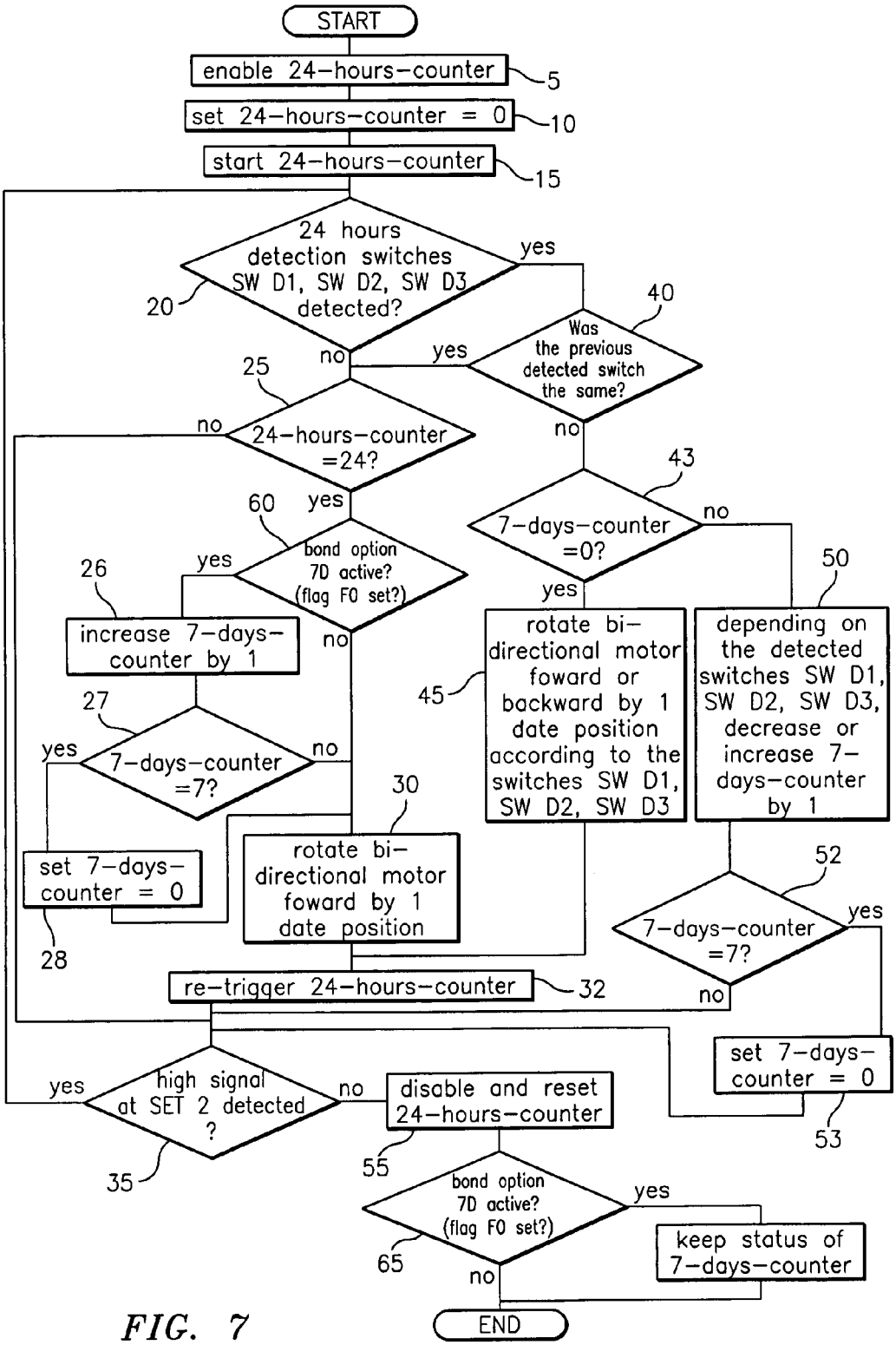
FIG. 7 is a flow chart illustrating a methodology of maintaining accurate date and/or day information, all in accordance with the present invention.

Reference is now made to FIG. 7 which illustrates a methodology in accordance with the present invention, namely the methodology associated with rotating date ring 12 and day disc 94. In particular, the methodology of FIG. 7 is preferably used to maintain accurately displayed date and/or day information in a device, such as in timepiece 1 constructed in accordance with the foregoing disclosure.

The methodology preferably begins with the initialization of one or more counters, such as enabling (step 5), initializing (step 10) and starting (step 15) a "24HR" counter.

Thereafter, the methodology preferably determines (at step 20) whether there has been sufficient rotation of the detection wheel assembly 53, namely whether there has been a detection of contact between one of the fingers (72, 73, 74) and one of the associated pads (80, 81, 82). If not, the methodology proceeds to step 25 wherein it is determined whether the "24HR" counter has reached a count of 24 hours, and if so, causes the stepping (at step 30) of the rotor of first stepping motor 20 in a direction so that date ring 12 rotates and a (subsequent) digit on date ring 12 representing the next valid date is displayed. The 24HR counter may thereafter be reinitialized at step 32.

As seen by the determination at step 35, the foregoing steps are continued as long as microcontroller 60 or a separate quartz analog circuit has stopped the rotation of the rotor of second stepping motor 30 (i.e. the hands have been stopped from rotation), such as by the axial displacement of setting stem 100 into the position illustrated in FIG. 4, whereby the toothed wheel 104 of setting stem 100 is rotateably engaged with setting wheel 105. Hence, the method provides for the commencing of subsequent measurements of elapsed periods of time while the microcontroller or a separate quartz analog circuit is still not providing signaling to rotate the rotor of second stepping motor 30; determining when the elapsed period of time measured in the subsequent measurement is at least essentially equal to 24 hours; and the stepping of the rotor of stepping motor 20 in the proper direction so that date ring 12 rotates and a next subsequent digit on date ring 12 is displayed. The foregoing sequence of stepping the rotor of first stepping motor 20 at least essentially every 24 hours so that the date ring rotates and a next (subsequent) digit representing the next valid date is displayed, is continually performed as long as the microcontroller or a separate quartz analog circuit is not providing signaling to rotate the rotor of second stepping motor 30.

It appears most appropriate at this juncture to again highlight one of the novel features of the present invention, namely the ability to maintain accurate date information during manual setting of day disc 94. That is, in setting the proper day information, such as after the hands have been stopped for a number of days (and keeping in mind that the date ring 12 has been rotating every 24 hours), it is important that the microcontroller does not overrotate date ring 12, even though the setting stem and thus the hour wheel 48 are rotating. It is for this reason that steps 26–28 are important.

Specifically, the methodology of the present invention also includes the steps of measuring the number of elapsed 24-hour periods of time (at step 25). The number of days that elapse in this mode when the hands are not rotating are maintained by the sequence of steps 26–28, wherein a "7DAY" counter keeps count of the number of elapsed 24 hour periods (step 26). When the 7DAY counter reaches a value of 7 (step 27), it is reset (step 28). It should be appreciated that having the 7DAY counter reach, for example 11 (or 18, etc.) would result in the same adjustment as if the 7DAY counter only reached 4. Since the feature now being described is the ability to block rotation of date ring 12 while day disc 94 is being adjusted, it should now be understood that the microcontroller will maintain date ring 12 in position (i.e. with no further rotation) even though microcontroller 60 will be detecting that the detection wheel assembly 53 is passing through the midnight position in the forward direction (i.e. finger 73 may be electrically contacting pad 81 after finger 72 has electrically contacted pad 80), or in the backward direction (i.e. finger 72 may be electrically contacting pad 80 after finger 73 has electrically contacted pad 81). However, microcontroller 60 will not cause the rotation of stepping motor 20 until the number of detected contacts between fingers 72 and 73 and their associated pads 80 and 81 equals the current value in the 7DAY counter. In this way, after the hands are stopped and it is desired to adjust the day disc, the date ring will not rotate until the days and thus the date have been correctly realigned.

Clearly, one skilled in the art would appreciate that the foregoing example assumes that the day ring is being rotated in a particular direction (counterclockwise or clockwise). That is, if the day ring were to be adjusted by being rotated in the opposite direction, the number of contacts between finger 73 and its associated pad 81 that microcontroller 60 would want to remain blocked (i.e. with no rotation of the date ring) would be the value of the 7DAY counter subtracted from 7. In this way, the day disc could be adjusted in either a forward or reverse direction, while the date ring could remain blocked for the appropriate number of "days."

Thus, it can be seen that day disc 94 can be adjusted manually by rotation of setting stem 100 and hour wheel 48. However this sequence of steps results in the rotation of detection wheel assembly 53. Hence, the blocking of further rotation of date ring 12 is achieved by suppressing any actions by microcontroller 60 which would normally result from the signaling to the microcontroller 60 by the rotation of detection wheel assembly 53.

As indicated above, FIG. 7 also provides the preferred methodology for normal operation (i.e. when the rotor of second stepping motor 30 is rotating under the normal control of microcontroller 60). In such a normal mode, the rotation of date ring 12 is determined by the signaling provided by detection wheel assembly 53.

Specifically, in the normal "run" mode of timepiece 1, the methodology to maintain and display date and/or day information comprises the steps of determining (at step 40) that the detection wheel has been rotated a certain number of rotational increments in the clockwise or counterclockwise direction; and causing the rotor of stepping motor 20 to rotate (step 45) so that the date ring can be rotated in one of a clockwise or counterclockwise direction. The details of the foregoing steps are set forth in greater detail above where the details of the detection wheel assembly 53 are disclosed. However, for completeness, it should now be understood that the present method may comprise the steps of:

rotating date ring 12 in a clockwise or counterclockwise direction if microcontroller 60 detects an electrical connection between the second finger and the second conductive pad and the previously detected electrical connection was between the first finger and the first conductive pad; and rotating the date ring in the other direction if the microcontroller detects an electrical connection between the first finger and the first conductive pad when the previously detected electrical connection was between the second finger and the second conductive pad.

Other features provided are likewise set forth in FIG. 7. For example, if the displayed day at intermediate step 43 has been determined to be incorrect (i.e. 7DAY counter has a value different from "0" stored therein), depending on the sequence of detected electrical contacts between fingers 72, 73, 74 and respective pads 80, 81, 82, the 7DAY counter is adjusted at step 50. Thereafter, the 7DAY counter is adjusted at steps 52 and 53 in a similar way to the steps set forth above at steps 26–28. In this way, upon the manual adjustment of day disc 94, the appropriate amount of blocking of rotation of date ring 12 can be effectuated, in the manner set forth above.

To complete the description of FIG. 7, it can be seen that if microcontroller 60 is in a mode where the stepping of the rotor of stepping motor 30 is enabled (i.e. the decision at step 35 is answered in the negative), the methodology preferably disables and resets (at step 55) the 24HR counter, and presumably, timepiece 1 is back in its normal "run mode."

Steps 60, 65 are optionally provided as a means to provide for the day setting features of the present invention.

It can thus be seen that the present invention provide numerous advantages not found in the prior art. For example, the present invention provides an improved timepiece comprising a date and/or day display that utilizes stepping motors, as well an improved timepiece comprising a date and/or day display that is easy to adjust and furthermore, whereby the accuracy of the calendar date and/or day can be continuously and accurately maintained. Furthermore, the preferred methodology ensures that maintaining accurate date information does not require any particular time reference to compute the elapsed 24-hour periods of time. Still further, the present invention provides for a new and improved method for adjusting day information while not allowing further discrepancies with the date information. In fact, the present invention ensure a faster and more accurate and efficient day/date calibration than found in the prior art. Still further, but by no means any less important, the present invention provides an improved construction that does not require the precision electrical contact reliability which is otherwise needed in prior art embodiments.

Lastly, to be sure the invention is well understood, it is noted for completeness that the preferred third wheel 40 construction is a two-piece part assembly (combining the wheel and pinion portions), which is designed to enable friction during hand setting. In this way, there can be proper disabling of the second hand (not shown) and stepping motor 30. Moreover, and as would thus be appreciated, as motor 30 is disabled, such as that when setting stem 100 is in the position illustrated in FIG. 4, the present invention can better conserve battery life, while simultaneously having the hands stopped but always showing correct date, if desired.

While the invention has been particularly shown and described with respect to preferred embodiments thereof, it will be understood by those skilled in the art that changes in form and details may be made therein without departing from the scope and spirit of the invention.

What is claimed is:

1. A timepiece comprising a date display, wherein the timepiece comprises:

a date display assembly comprising:

a date ring having a plurality of digits thereon;

a first gearing assembly comprising one or more wheels, being meshingly coupled to the date ring so that the rotation of the one or more wheels causes the rotation of the date ring; and a stepping motor comprising a rotor, wherein the rotor of the stepping motor is rotatably coupled to the at least one or more wheels of the first gearing assembly, wherein the rotation of the rotor causes the date ring to rotate;

a date-keeping assembly operatively coupled to the date display assembly, comprising:

at least a second gearing assembly comprising at least an hour wheel and a detection wheel assembly operatively coupled by rotation to the hour wheel; a spring assembly comprising at least three deflectable fingers; and wherein the detection wheel assembly comprises a first tab, a second tab and a third tab, wherein each tab is positioned such that:

only the first tab is contactable with the first finger;

only the second tab is contactable with the second finger; and only the third tab is contactable with the third finger;

wherein at least certain rotational increments of the detection wheel assembly, and the clockwise or counterclockwise direction thereof, causes the rotor of the stepping motor to rotate so that the date ring can be rotated in one of a clockwise or counterclockwise direction;

whereby the rotation of the hour wheel through a predetermined midnight position results in that the stepping motor causes the date ring to rotate a predetermined number of degrees, thereby advancing either in the forward or backward direction a displayed digit on the date ring.

2. The timepiece as claimed in claim 1, wherein the date-keeping assembly comprises:

at least a second stepping motor comprising a rotor, wherein the rotor of the at least second stepping motor is operatively coupled to the hour wheel;

wherein the hour wheel is rotateable by the rotation of the at least second stepping motor.

3. The timepiece as claimed in claim 2, wherein the date-keeping assembly comprises an intermediate date wheel that is meshingly engaged between the hour wheel and the detection wheel, such that:

the rotation of the hour wheel causes the intermediate date wheel to rotate, and the intermediate date wheel imparts rotation to the detection wheel;

wherein the intermediate date wheel is dimensioned to ensure that the hour wheel and the detection wheel rotate at a 2:1 ratio.

4. The timepiece as claimed in claim 1, wherein each tab is positioned in a different horizontal plane and offset from each other when viewed along a longitudinal axis of the detection wheel.

5. The timepiece as claimed in claim 1, wherein the date-keeping assembly comprises:

first, second and third electrically conductive pads to which each of the respective three deflectable fingers can make contact;

wherein when:

the first tab contacts the first finger, the first finger makes electrical contact with the first conductive pad;

the second tab contacts the second finger, the second finger makes electrical contact with the second conductive pad;

the third tab contacts the third finger, the third finger makes electrical contact with the third conductive pad, and no two fingers can simultaneously make electrical contact with their respective pads;

wherein a microcontroller or a quartz analog circuit maintains information about the rotation of the detection wheel, and whether the detection wheel is rotating in the clockwise or counterclockwise direction, based on the respective sequence of contacts between the deflectable fingers and their respective conductive pads.

6. The timepiece as claimed in claim 1, comprising a casing, and a display window for displaying a date, wherein the date ring is aligned in the casing such that each of the plurality of digits is appearable in the display window.

7. A method of maintaining and displaying at least one of date and day information in a timepiece, wherein the timepiece comprises:

a date display assembly comprising a date ring having a plurality of digits thereon, a first gearing assembly comprising one or more wheels being meshingly coupled to the date ring so that the rotation of the one or more wheels causes the rotation of the date ring, and a first stepping motor comprising a rotor, wherein the rotor of the first stepping motor is rotatably coupled to the at least one or more wheels of the first gearing assembly, wherein the rotation of the rotor causes the date ring to rotate;

a date-keeping assembly operatively coupled to the date display assembly, the date-keeping assembly comprising an hour wheel and a detection wheel, assembly operatively coupled by rotation to the hour wheel, means for signaling the stepping of the first stepping motor, wherein at least certain rotational increments of the detection wheel assembly, and the clockwise or counterclockwise direction thereof, provides signals to the means to cause the rotor of the first stepping motor to rotate; and at least a second stepping motor comprising a rotor, wherein the rotor of the at least second stepping motor is operatively coupled by rotation to the hour wheel, wherein the hour wheel is rotateable at least in part by the rotation of the second stepping motor; wherein the rotation of the rotor of the second stepping motor is caused by and under the control of the means;

a setting stem removably engageable with a gearing arrangement which itself is engageable with the hour wheel, and wherein the hour wheel is rotateably coupled to a day disc which includes a plurality of day indicia thereon indicative of the days of the week;

wherein the method comprises the steps of:

determining when the means has stopped the rotation of the rotor of the second stepping motor, and commencing a measuring of an elapsed period of time; wherein the commencement of the measurement step is independent of the time of day;

determining when the elapsed period of time is at least essentially equal to 24 hours; and stepping the rotor of the first stepping motor in a direction so that the date ring rotates and the digit on the date ring showing the next correct date is displayed;

measuring the number of elapsed 24 hour periods of time; and, while the means are not providing signaling to rotate the second stepping motor and the setting stem is engaged with the gearing arrangement:

adjusting the day disc by rotating the setting stem, wherein the day disc is adjustably rotated a calculated number of days depending on the number of measured elapsed 24 hour period of times; and blocking further rotation of the date ring by preventing the rotation of the rotor of the first stepping motor until the day disc has been rotated the calculated number of days.

8. The method as claimed in claim 7, including the steps of:

commencing a subsequent measurement of an elapsed period of time while the means is still not providing signaling to rotate the rotor of the second stepping motor;

determining when the elapsed period of time measured in the subsequent measurement is at least essentially equal to 24 hours; and stepping the rotor of the first stepping motor in the direction so that the date ring rotates and the digit on the date ring showing the next correct date is displayed.

9. The method as claimed in claim 8, including the steps of:

continually commencing additional measurements of elapsed periods of time as long as the means is not providing signaling to rotate the second stepping motor; and stepping the rotor of the first stepping motor, at least essentially every 24 hours in the direction, so that the date ring rotates and the digit showing the next correct date is displayed.

10. The method as claimed in claim 7, wherein the blocking step includes the suppression of signaling from the means to the first stepping motor to rotate the rotor thereof.

11. The method as claimed in claim 7, including a day counter that maintains the number of measured elapsed 24-hour periods of time; wherein the method includes the steps of:

determining if the number of elapsed 24 hour periods of time is equal to seven (7); and if so:

initializing the day counter to a starting value.

12. The method as claimed in claim 7, wherein the means is a microcontroller or a quartz analog circuit.

13. A method of maintaining and displaying at least one of date and day information in a timepiece, wherein the timepiece comprises:

a date display assembly comprising:

a date ring having a plurality of digits thereon, a first gearing assembly comprising one or more wheels being meshingly coupled to the date ring so that the rotation of the one or more wheels causes the rotation of the date ring, and a stepping motor comprising a rotor, wherein the rotor of the stepping motor is rotateably coupled to the at least one or more wheels of the first gearing assembly, wherein the rotation of the rotor causes the date ring to rotate;

a date-keeping assembly operatively coupled to the date ring assembly, the date-keeping assembly comprising:

an hour wheel, and a detection wheel assembly operatively coupled by rotation to the hour wheel, a spring assembly comprising at least three deflectable fingers, and the detection wheel assembly comprises a first tab, a second tab and a third tab, wherein each tab is positioned such that (i) only the first tab is contactable with the first finger; (ii) only the second tab is contactable wit the second finger; (iii) only the third tab is contactable with the third finger;

first, second and third electrically conductive pads to which each of the respective three deflectable fingers can make contact;

wherein when:

the first tab contacts the first finger, the first finger makes electrical contact with the first conductive pad;

the second tab contacts the second finger, the second finger makes electrical contact with the second conductive pad;

the third tab contacts the third finger, the third finger makes electrical contact with the third conductive pad, and no two fingers can simultaneously make electrical contact with their respective pads;

wherein a means can maintain information about the rotation of the detection wheel assembly and whether the detection wheel is rotating in the clockwise or counterclockwise direction based on the respective sequence of contacts between the deflectable fingers and their respective conductive pads;

wherein at least certain rotational increments of the detection wheel assembly, and the clockwise or counterclockwise direction thereof, causes the rotor of the stepping motor to rotate so that the date ring can be rotated in one of a clockwise or counterclockwise direction, wherein the method comprises the steps of;

determining that the detection wheel assembly has been rotated a certain number of rotation increments in clockwise or counterclockwise direction; and causing the rotor of the stepping motor in rotate so that the date ring can be rotated in one of a clockwise or counterclockwise direction;

rotating the date ring in one of a clockwise and counterclockwise direction if:

the means detects an electrical connection between the second finger and the second conductive pad and the previously detected electrical connection was between the first finger and the first conductive pad; and rotating the date ring in the other of the clockwise or counterclockwise direction if:

the means detects an electrical connection between the first finger and the first conductive pad after the previously detected electrical connection being between the second finger and the second conductive pad.

* * * * *